US006227767B1

(12) United States Patent
Mosing et al.

(10) Patent No.: US 6,227,767 B1
(45) Date of Patent: May 8, 2001

(54) PILE DRIVING ADAPTER

(75) Inventors: Donald E. Mosing; Charles M. Webre, both of Lafayette, LA (US)

(73) Assignee: Frank's Casing Crew and Rental Tools, Inc., Lafayette, LA (US)

( * ) Notice: Subject to any disclaimer, the term of this patent is extended or adjusted under 35 U.S.C. 154(b) by 0 days.

(21) Appl. No.: 09/149,470

(22) Filed: Sep. 8, 1998

(51) Int. Cl.[7] ..... E02D 7/02
(52) U.S. Cl. ..... 405/249; 405/251; 405/232
(58) Field of Search ..... 405/228, 231, 405/232, 245, 251, 252, 253, 255, 249; 173/128, 130, 132, 133, 90, 91

(56) References Cited

U.S. PATENT DOCUMENTS 1,005,889 * 10/1911 Schalscha ..... 173/130
1,954,070 * 4/1934 Cook ..... 405/251 X
3,308,627 * 3/1967 Guild ..... 405/245

* cited by examiner

*Primary Examiner*—David Bagnell
*Assistant Examiner*—Sunil Singh
(74) *Attorney, Agent, or Firm*—John D. Jeter

(57) ABSTRACT

A pile driving adapter having at least one surface provided to abut the driven piling with the driver surface profiled to match the surface profile on the end of the piling. A tubular portion is arranged to receive the hammer blows. A transition portion provides rework material for the driver surface and a choice of a guide sleeve or a guide plug, extending downward from the transition portion, helps guide the adapter onto the piling.

6 Claims, 2 Drawing Sheets

PILE DRIVING ADAPTER

This invention pertains to a pile driving adapter for use in driving pipe with beveled ends with a pile driving hammer.

BACKGROUND OF THE INVENTION

Pile driving hammers have been in use for many years for driving tubular pilings. Typically, pipe columns are assembled by on-site joining of pipe sections by welding. When welded casing came into use, the final end preparation was done on site and care in preserving a prepared end was not especially important. To the extent practical all pipe sections are now prepared in the shop. Shop preparation for serial welding of pipe sections into pipe strings involves cutting a bevel on each end of each pipe section, excepting the lower terminal. Joining of shop prepared pipe sections is a field operation involving a great deal of tied-up assets. Delays in the field for repair of damaged pipe ends is especially costly.

Hammering directly on the prepared end of the top pipe section will promptly damage the prepared profile and necessitate on-site repairs. The prepared end of the pipe section does have a flat area which is usually less than one fourth the radial dimension of the bevel. The use of a flat ended driving adapter as an insert between the top of the pipe and the hammer reduces the damage to the end of the pipe, and repair after driving is often unnecessary. The damage does, however, sometimes occur. Quite possibly some damage goes unnoticed and results in welding an impaired junction.

Two bevel angles are commonly found in current practice. Thirty degree and fifteen degree bevels, relative to a transverse plane, can be driven with the same adapter if the combined angles are situated to engage the different angles on areas where hammering causes no damage. A suitable combined angle on the driver places the engaged portion of the thirty degree angle to involve about two thirds of the radial dimension of the bevel near the pipe bore. The fifteen degree angle, then, is engaged by about one third of the bevel near the outer dimension. Any marring of the outer portion of the bevel is covered satisfactorily by the weld metal deposit and does not compromise joint quality. For the thirty degree bevel, the adapter bevel is more acute by about one degree to more lightly engage the pipe bevel surface near the bore to avoid deforming the bore.

Welding bevels are not always the same but their characteristics are known well in advance of on-site use. That provides opportunity to prepare a driving adapter that engages the pipe over a large area of the end profile, and surface combinations on the driving adapter, as stated above, can be devised.

It is therefore an object of this invention to provide a pipe driving adapter for use between the top end of a pipe column and the pile driving hammer that is shaped to engage the general profile of the end surface of the pipe.

These and other objects, advantages, and features of this invention will be apparent to those skilled in the art from a consideration of this specification, including the attached claims and appended drawings.

SUMMARY OF THE INVENTION

A pile driving adapter for use on top of pipe with ends prepared for welding has a tubular upper portion to receive hammer blows with a transition portion shaped to engage the shaped profile of the pipe end. The beveled portion of the pipe end is much larger than the flat portion and it is usually not necessary to engage the flat portion with the adapter. The pipe engaging face of the adapter usually needs only to be beveled. To ease installation of the adapter on pipe, two options are provided. A tapered plug can extend downward from the transition portion to go into the bore of the pipe to be driven, or an oversize sleeve can extend downward from the transition portion to guide the adapter onto the pipe. Optional pad eyes are provided on the upper portion to aid in handling the adapter and, if necessary, to secure the adapter to the pile driving hammer to facilitate installation of the adapter. Optionally, a combined conical angle on the adapter cone surfaces can be used to drive pipes with different bevel angles.

BRIEF DESCRIPTION OF DRAWINGS

In the drawings wherein like features have similar captions.

DETAILED DESCRIPTION OF DRAWINGS

Figure 1:
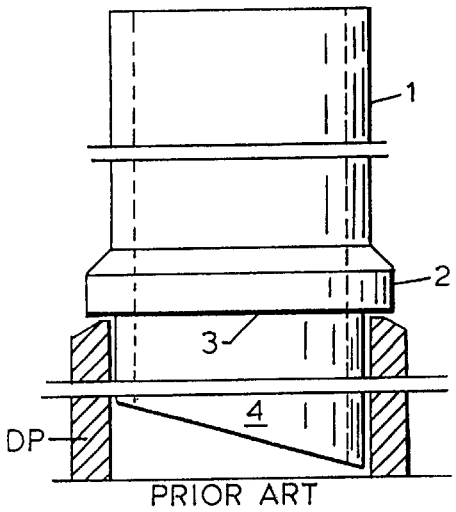
FIG. 1 represents prior art and is a side elevation, mostly cut away.

In the drawings certain features well established in the art and not bearing upon points of novelty are omitted in the interest of descriptive clarity. Such omitted features may include weld lines, some threaded fasteners, threaded joints, pins and the like.

In FIG. 1 prior art is illustrated. Upper extension 1 provides means to receive hammer blows. Shoulder 2 provides resurface material for face 3 which may be periodically damaged. Extension 4, normally a plug smaller than the bore of pipe to be driven helps guide the adapter onto the pipe and retains it in position.

Figure 2:
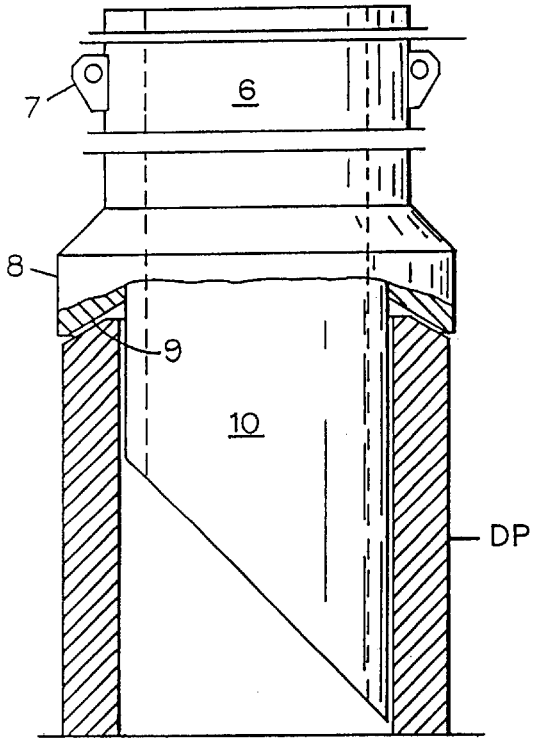
FIG. 2 is a side view, mostly cut away, of the preferred embodiment of the invention.

FIG. 2 shows the improved adapter in the plug aligned version. Upper tubular extension 6 has optional handling attachment means in the form of pad eyes 7 and transition portion 8 with conical surface 9 to engage the beveled face of a pipe end. Plug 10 helps guide the adapter onto the piling to be driven DP. The shoulder 8 provides rework stock for the conical surface. Plug 10 can be made removable (not shown) to fit the adapter to different sized pipe. A smaller plug 10 can be used with an optional sleeve (not shown) about it's periphery to ease adaptation to fit different pipe sizes.

Figure 3:
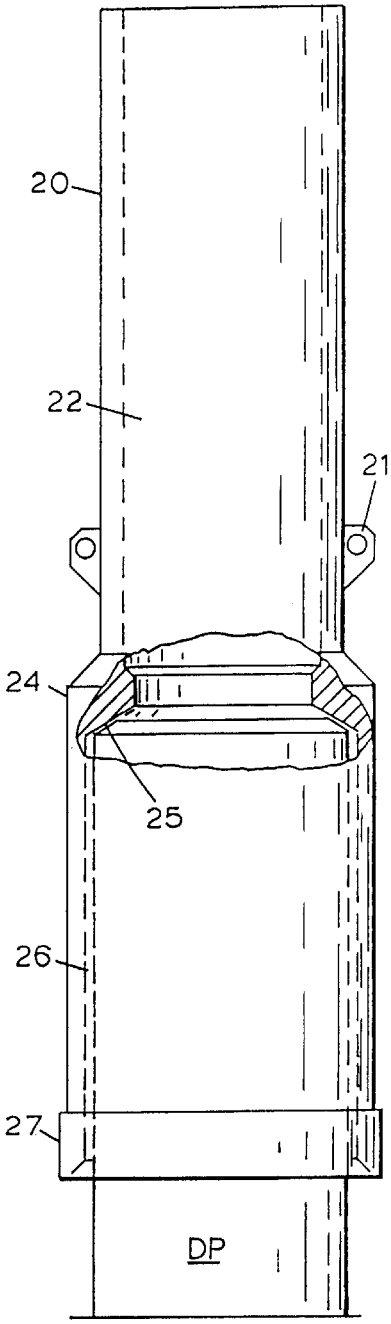
FIG. 3 is a side view of an alternate form of the invention.

FIG. 3 shows the sleeve aligned version of the adapter. Upper tubular portion 20 has optional pad eyes 21. Transition portion 24 has concave conical face 25 and sleeve extension 26 somewhat larger than the piling to be driven DP. Flange 27 adds strength to the lower end of the adapter. Tubular portion 20 can be larger or smaller than tubular portion 26. Sleeve extension 26 can be fitted with a liner (not shown) for adaptation to driving smaller pipe.

Figure 4:
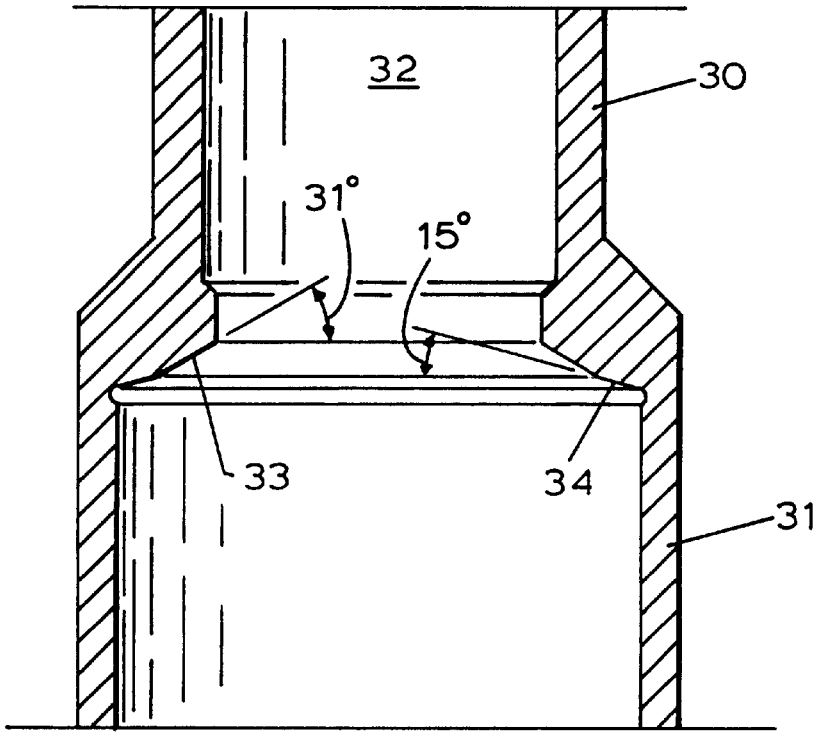
FIG. 4 is a side elevation, rather enlarged, of a selected portion of FIG. 3 with an alternate dual angle driving face.

FIG. 4 shows details of the driving face of a sleeve aligned adapter similar to the adapter of FIG. 3. The adaptation can be used on the driver of FIG. 2 as well. The tubular portion 30 with bore 32 and sleeve extension 31 has bevel 34 cut at about fifteen degrees and bevel 33 cut at about thirty one degrees. Pipe with a fifteen degree bevel is engaged by bevel 34 and thirty degree bevels are engaged by bevel surface 33.

By increasing the bevel face one degree, pipe bore damage is avoided. The fifteen degree angle does not approach the pipe bore and damage to the bore is avoided.

It will be understood that certain features and sub-combinations are of utility and may be employed without reference to other features and sub-combinations. This is contemplated by and is within the scope of the claims.

As many possible embodiments may be made of the adapter of this invention without departing from the scope thereof, it is to be understood that all matter herein set forth or shown in the accompanying drawings is to be interpreted as illustrative and not in a limiting sense.

What is claimed is:

1. A pile driving adapter for use between a hammer and the top of a pipe column with beveled surface prepared for welding, the adapter comprising:

a) a composite construction comprising an upper tubular extension, a transition portion, and a guide plug;

b) said upper tubular extension of a preselected length;

c) said transition portion with at least one concave conical surface opening downward and situated to directly engage, for transmission of driving energy, the beveled surface of the pipe; and d) said guide plug extending downwardly, a preselected distance, from said transition portion.

2. A pile driving adapter for use between a hammer and the top of a pipe column with beveled surface prepared for welding, the adapter comprising:

a) a composite construction comprising an upper tubular extension, a transition portion, and a guide sleeve;

b) said upper tubular extension of a preselected length;

c) said transition portion with at least one concave conical surface opening downward and situated to directly engage, for transmission of driving energy, the beveled surface of the pipe; and d) said guide sleeve with a bore larger than said surface extending downwardly, some preselected distance, from said transition portion.

3. A pile driving adapter for use between a hammer and the top of a pipe column with beveled surface prepared for welding, the adapter comprising:

a) a composite construction comprising an upper tubular extension, a transition portion, and a guide plug;

b) said upper tubular extension of a preselected length;

c) said transition portion with concave conical surfaces opening downward, said concave surfaces comprising an inner and an outer conical surface of different angularity, the larger angle, relative to a transverse plane, continuing inwardly from said outer conical surface said outer surface situated to directly engage, for transmission of driving energy, the beveled surface of the pipe; and d) said guide plug extending downwardly, a preselected distance, from said transition portion.

4. The adapter of claim 3 wherein said inner angle is about thirty-one degrees, relative to the transverse plane, the outer angle being about fifteen degrees, relative to the transverse plane.

5. A pile driving adapter for use between a hammer and the top of a pipe column with beveled surface prepared for welding, the improved adapter comprising:

a) a composite construction comprising an upper tubular extension, and a transition portion, and a guide sleeve;

b) said upper tubular extension of a preselected length;

c) said transition portion with concave conical surfaces opening downward, said concave surfaces comprising an inner and an outer conical surface of different angularity, relative to a transverse plane, the larger angle being the inner angle, nearer the axis of said tubular extension, said outer conical surface situated to directly engage, for driving, the beveled surface of the pipe prepared for welding; and d) said guide sleeve with a bore larger than said concave conical surfaces extending downwardly, some preselected distance, from said transition portion.

6. The adapter of claim 5 wherein said inner angle is about thirty-one degrees, relative to the transverse plane, the outer angle being about fifteen degrees, relative to the transverse plane.

* * * * *